US005903088A

United States Patent [19]

Sugitani et al.

[11] Patent Number: 5,903,088

[45] Date of Patent: May 11, 1999

[54] SHORT ARC LAMP HAVING A THERMALLY CONDUCTIVE RING

[75] Inventors: Akihiko Sugitani; Kenzo Kai, both of Himeji; Masanori Takahashi, Takamago; Hideo Tanaka, Himeji, all of Japan

[73] Assignee: Ushiodenki Kabushiki Kaisha, Tokyo, Japan

[21] Appl. No.: 08/531,154

[22] Filed: Sep. 15, 1995

Related U.S. Application Data

[63] Continuation-in-part of application No. 08/493,101, Jun. 21, 1995, abandoned.

[30] Foreign Application Priority Data

Jun. 21, 1994 [JP] Japan ..... 6-160794

[51] Int. Cl.[6] ..... H01J 1/02

[52] U.S. Cl. ..... 313/46; 313/113; 313/634

[58] Field of Search ..... 313/46, 113, 634

[56] References Cited

U.S. PATENT DOCUMENTS

| | | | |
|---|---|---|---|
| 3,715,613 | 2/1973 | Parkman | 313/113 |
| 3,725,714 | 4/1973 | Anderson | 313/113 |
| 4,179,037 | 12/1979 | Chan et al. | 313/113 |
| 4,633,128 | 12/1986 | Roberts et al. | 313/113 |
| 4,658,179 | 4/1987 | Roberts | 313/113 |
| 5,399,931 | 3/1995 | Roberts | 313/113 |

*Primary Examiner*—Sandra L. O'Shea
*Assistant Examiner*—Vip Patel
*Attorney, Agent, or Firm*—Sixbey, Freedman, Leedom & Ferguson; David S. Safran

[57] ABSTRACT

A short arc lamp which has a lamp body in which a concave space is formed, a base plate which is located in a rear part of this body, a transparent part which is located in a front opening of the lamp body, with a frame part in its vicinity, and which hermetically encloses the concave space, and a pair of electrodes forming an arc gap in the concave space. The frame part is connected to a circular conductive ring which is provided with the roughly square cross section and is connected to the lamp body. At least a front side of the circular conductive ring is exposed to the ambient environment. A gap is formed between the frame part and the circular conductive ring. The frame part extends more to the front than the circular conductive ring, and on the exposed surface of the circular conductive ring and on a side of the projecting part of the frame part, step-like projections are formed.

8 Claims, 2 Drawing Sheets

SHORT ARC LAMP HAVING A THERMALLY CONDUCTIVE RING

Cross Reference to Related Application

This application is a continuation-in-part of U.S. patent application Ser. No. 08/493,101 filed Jun. 21, 1995 now abandoned.

BACKGROUND OF THE INVENTION

1. Field of the Invention

The invention relates to a short arc lamp, especially a lamp in which the body of the main part of the lamp is made of an opaque ceramic and only a front opening is made of a transparent part.

2. Description of the Related Art

Generally, a short arc lamp is formed of quartz glass or the like. However, a special lamp is also used in which the main part of the lamp is made of an opaque ceramic for a special purpose, such as for a medical endoscope.

One such lamp has the advantage that it is extremely durable and easy to handle. For example, such lamps are known from U.S. Pat. Nos. 4,599,540; 4,633,128 and 3,731,133. Specifically, within the ceramic body, a concave space is formed in which gas with increased air pressure is encapsulated, and into the front opening of which a transparent part is installed. In the middle of this concave space are a cathode and anode which form an arc gap. By means of a discharge which is formed in this arc gap, lamp emission is accomplished. In this case, the anode is held on a back end of the body, and the cathode is secured by means of a conductive part which extends from one side of a front end of the body. On the other hand, the transparent part in its vicinity has a U-shaped flange and is attached in the front opening of the above-described body.

Within the lamp, not only this flange, but also a spacer and the like are located. These parts hermetically enclose the inside of the lamp and at the same time have the function of a conductive part for generating the arc.

A lamp of this type does have the advantage of durability and easy handling, as is described above. However, it has the disadvantage that the heat formed in the concave space of the lamp cannot be advantageously dissipated to the outside. In particular, only on the cathode side is there an arrangement in which the main part of the cathode is secured by means of the conductive part. It is difficult to completely transfer the heat by means of this conductive part. Furthermore, the efficiency of heat emission is seriously impaired when the transparent part, the flange, the body and the like are not in complete contact with one another.

If this heat emission is not adequate, a resultant temperature increase of the above-described parts which form the lamp can lead to deformation thereof. In particular, the U-shaped flange, due to its special shape, is easily deformed. If these parts deform and complete contact with the body and the transparent part is destroyed, the hermetically sealed state is destroyed, and furthermore, conductivity is impaired.

SUMMARY OF THE INVENTION

Therefore, a primary object of the present invention is to devise a short arc lamp which has an advantageous emission of the heat formed within the lamp.

This object is achieved, according to the invention, by the fact that, in a short arc lamp which has a lamp body within which a concave space which has a curved reflection surface is formed and in a rear part of which a through opening is formed which leads to this concave space. Furthermore, a base plate which is located in a rear part of this body and which is connected to the above-described body is provided, along with a transparent part which is located in a front opening of the lamp body, with a frame part in its vicinity, and which hermetically encloses the above-described concave space. A pair of electrodes are located in the above-described concave space at a distance from each other and at a focal point of the above-described reflection surface. These electrodes can be formed of an anode held on the above-described base plate and of a cathode which is held by means of a conductive part which extends from one side of the above-described body. The above-described frame part is located in the vicinity of the cathode, has a circular conductive ring provided with a roughly square cross-section and is connected to the above-described body while, at the same time, at least a front side of the circular conductive ring is exposed to an outside space.

The above-noted object is, furthermore, achieved according to the invention by the fact that the frame part and the circular conductive ring are interconnected in a rear part thereof, and that from there outward in the direction to the outside space there is a gap. The object is further facilitated by the fact that the described gap extends conically to the outside space.

The object is moreover achieved according to the invention by the fact that the frame part extends upward more to the front than the circular conductive ring, and that on the surface of the circular conductive ring which is exposed to the outside space, and on one side of the projecting part of the frame part, steps are formed.

DETAILED DESCRIPTION OF THE PREFERRED EMBODIMENT

Figure 1:
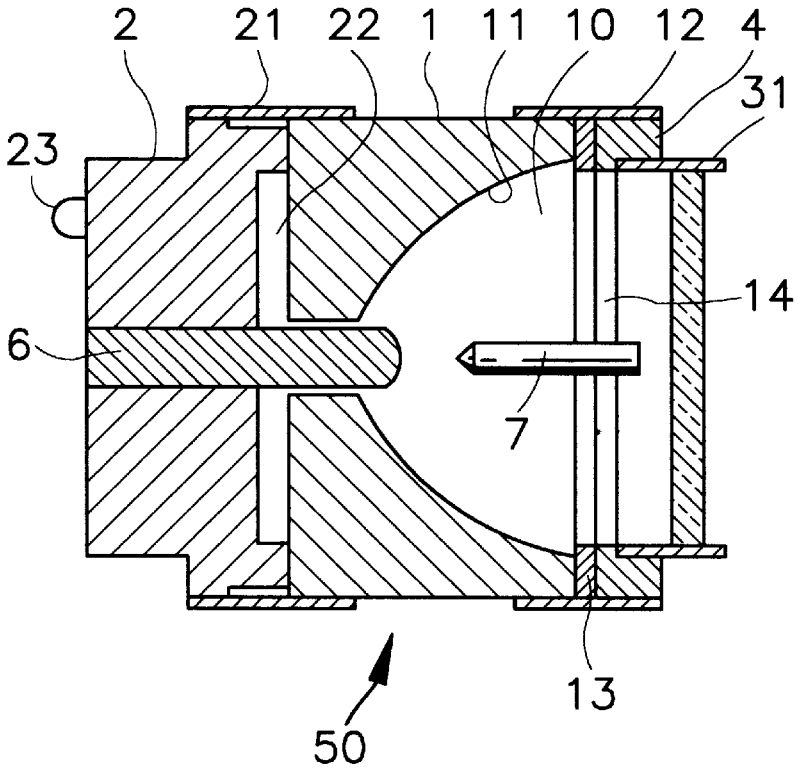
FIG. 1 a cross-sectional view of a short arc lamp according to a preferred embodiment of the invention.

FIG. 1 shows a preferred embodiment of a short arc lamp according to the invention, which is comprised of a lamp body 1, a base plate 2, and a transparent part 3 or the like. The lamp body 1, base plate 2, and transparent part 3 each have a roughly circular cross-section (in a plane normal to that shown in the drawings) and have a cylindrical shape overall.

Lamp body 1 is made, for example, of alumina ceramics and is opaque, except for a front opening into which a transparent part 3 is installed, and except for a rear opening, in order that no light is emitted to the outside. Within body 1, which forms a main part of the lamp, a compressed gas is encapsulated, and the lamp is formed overall from a durable material in order that it does not break. The lamp body 1, for example, has an outside diameter of 30 mm and a length of 20 mm.

Base plate 2 is made, for example, of an iron alloy and is joined by a band 21 to the lamp body 1. In this joining, band 21 is located horizontally on an outer peripheral surface of the body 1 and on an outer peripheral surface of the base plate 2 which are place one on top of the other, as is shown in FIG. 1.

Joining of band 21 to base plate 2 is effected by means of TIG welding (tungsten-inert gas welding), while joining of band 21 to the lamp body 1 is effected by coating an outside surface of body 1 with a mixture of molybdenum and manganese and by soldering between this mixture and connecting band 21. Furthermore, a copper plate is squeezed between body 1 and base plate 2.

As described below, base plate 2 performs both the function of a heat conducting part for emission of the heat formed in the anode to the outside environment, and also the function of an electrical conductor for delivering current to the anode. Space 22 formed between base plate 2 and body 1 is necessary with respect to production of the lamp in that it is used for both removing undesired gas from the inside of the gas and for delivering the desired gas. On the rear end of base plate 2, an end part 23 of a tube use for evacuation and pressurization of the lamp space 10, via base plate space 22, is formed. This end part 23 is made, for example, of nickel. Base plate 2 has, for example, an outer diameter of 30 mm and a length of 15 mm, and can, itself, be formed from iron, or from an iron alloy.

Within lamp body 1, a curved reflection surface 11 is formed and by which the concave space 10 is formed. Reflection surface 11 is shaped as a paraboloid, an ellipsoid, a spheriod or the like, and is formed by cathode sputtering of silver and aluminum or the like onto the inner surface of the lamp body 1, in order that advantageous emission of light from the front opening is effected.

Transparent part 3 is made, for example, of sapphire and acts as a light exit window. Transparent part 3 has a thickness of 3 mm, for example, with its periphery being circular or rounded, and surrounded by a frame part 31. Frame part 31 is made, for example, of KOVAR® (a trademark of Westinghouse, for an alloy whose main components are iron, nickel and cobalt) and has a width of roughly 6 mm and a ring-like shape. The transparent part 3 is joined to frame part 31 by the same method as body 1 is joined to band 21, that is, by soldering based on the above-described process using a molybdenum-manganese coating to produce a hermetic sealing of concave space 10.

Figure 2:
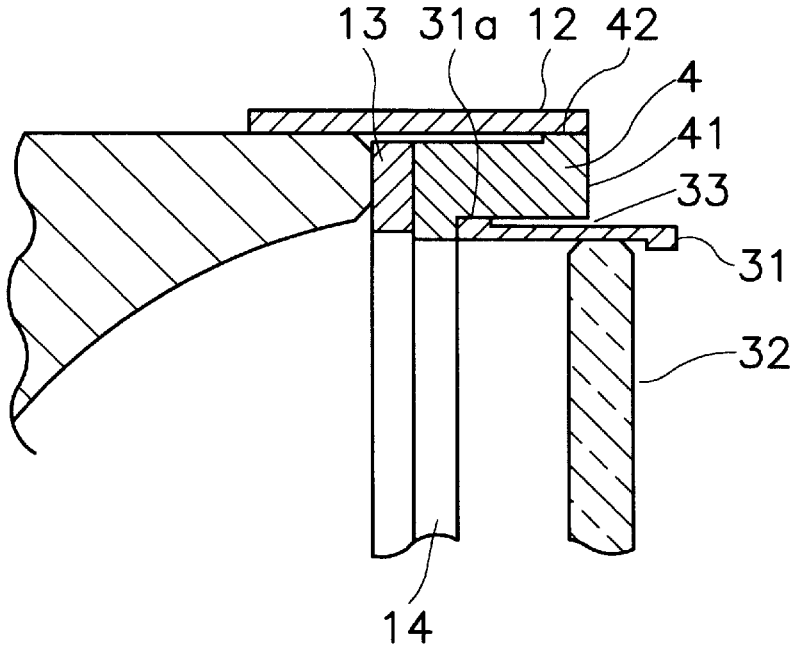
FIG. 2 schematically depicts an enlarged view of the important parts of the short arc lamp according to the invention.

Besides sapphire, for example, also zirconium earth can be used to make the transparent part 3. Between frame part 31 and lamp body 1, a conductive ring 4, conductive band 12 and spacer ring 13 are located, by means of which the front opening of body 1 is hermetically enclosed (as FIG. 2 shows) with the transparent part 3 being joined via frame part 31 to body 1. Transparent part 3 is located at a site which is a short distance rearward from front the front edge of the opening 32 of frame part 31. Specifically, it is located at a site with a rearward distance of roughly 1 mm, with the advantage of not damaging transparent part 3 in the case in which the lamp is temporarily placed face down on a surface. The reason that the lamp would be so placed is that, if placed on its side, the lamp would disadvantageously roll due to its cylindrical shape, and it cannot be rested with its rear end pointed downward due to the presence of the tube end part 23 on the rear end of the base 2, as described above.

Frame part 31 has an annular first projection 31 a on its edge that is directed toward the concave space 10, and frame part 31 is joined by this first projection 31*a* to the conductive ring 4 by means of soldering or direct TIG welding.

Conductive ring 4 has an outside diameter which is roughly as large as the outside diameter of lamp body 1. The rear side of ring 4 is connected via a spacer ring 13 to conductive part 14 which holds the cathode 7. Conductive ring 4 is a circular ring with a cross-section which has a roughly square shape exclusive of a projection 42 (described below) and a diagonally opposite projection forming a shoulder that is engaged by projection 31*a* of frame part 31. Ring 4 is made, for example, of KOVAR®. The front side of conductive ring 4, that is, the side 41 which faces in the direction of light emission from the lamp, is exposed to the ambient environment, and a cooling rib of a cooling device 63 (FIG. 3) can be brought into contact with a flat portion of this exposed side 41.

Conductive ring 4 and frame part 31 do not come directly into contact with one another except for above-described first projection 31*a* a gap 33 being formed therebetween, as is shown in FIG. 2 of the drawings. This gap 33 acts to relieve stress as the result of internal pressure from interior space 10 and to relieve thermal stress as the result of the temperature distribution/expansion differences. Without this gap 33, these stresses could exert a direct influence on conductive ring 4 and conductive band 12, and destroy the joined state thereof. Gap 33 has a size of, for example, roughly 0.1 mm and can be arranged, advantageously, such that it extends conically outwardly from the vicinity of the junction between projection 31*a* and ring 4. The gap 33, however, need not always be conical, but can also spread in steps or can maintain a uniform breadth. The frame part 31 projects further than the conductive ring 4. Steps 35 are formed on the exposed side 41 of the conductive ring 4 and on one side 34 of the projecting portion of the frame part 31.

On an outer peripheral surface of the conductive ring 4, the note second projection 42 is joined to the conductive band 12. This joining is, likewise, accomplished by soldering or direct TIG welding on second projection 42. Furthermore, joining of conductive band 12 to body 1 is also achieved by the above-described molybdenum-manganese coating process and soldering. By contact of between a cooling rib and this conductive band 12 (e.g., 51 in FIG. 3), an even higher heat dissipation effect can be obtained.

On the other hand, by means of the measure in which the cooling rib is brought into contact with an outer surface of conductive band 12 by placement of an electrical insulating plate, advantageous heat dissipation from the lamp can be achieved, while an electrically insulated state can be produced, as is described below.

The stress resulting from internal pressure in the concave space 10 and as the result of the temperature effects can be relieved by a measure by which a gap is also formed between the conductive band 12 and the conductive ring 4. Such a gap can be seen in FIG. 2 as resulting from the attachment of the band 12 on the radially outwardly directed face of the projection 42.

A rear surface of the conductive ring 4, i.e. the surface opposite the exposed surface 41 is brought into contact with spacer ring 13 via a copper packing (not shown), and the spacer ring 13 comes into direct contact with the lamp body 1 at its rear side, i.e., that facing away from ring 4. On the other hand, conductive ring 4 is also connected to conductive part 14. Spacer ring 13 is made, for example, of aluminum oxide.

By means of the above described measure, in which the conductive ring 4 of a roughly square cross-sectional shape is used, a greater thermal capacity is obtained (as compared to the prior art use of a U-shaped flange, mentioned in the Background portion above), and sufficient emission of the heat formed in the concave space, especially in the vicinity of the cathode, can be achieved. The expression "roughly square shape" as used herein, as apparent from the comment above, is intended to include the case in which there are few projections extending therefrom for use in conjunction with connection to associate parts.

Because the flat front side of conductive ring 4 is exposed to the environment, by means of the measure in which a cooling rib is brought into contact with this front side, an even better heat radiation effect can be achieved.

In a focal point of reflection surface 11 within concave space 10, the pair of electrodes 6, 7 are disposed with an arc gap therebetween. Anode 6 is attached to base plate 2 and has a flat tip which extends from there into the concave space 10. Anode 6, for example, has an outer diameter of 3 mm and is made of tungsten.

On the other hand, the cathode 7 is made of tungsten and is held by means of the conductive part 14 which extends from one side of the lamp body 1. The tip of cathode 7 disposed in opposition to the anode 6 is conical and the outer diameter of the cathode is roughly 1.6 mm. The arc gap formed between the anode 6 and cathode 7 is, for example, 1.4 mm. Conductive part 14 extends, for example, is formed of three support struts which extend from the side of the lamp body 1 into the concave space 10 (in the manner shown, e.g., in U.S. Pat. No. 4,599,540), and is made, for example, of molybdenum. A getter for absorbing impurities is incorporated into this conductive part 14; for example, zirconium which is designed to absorb contaminating gas present in concave space 10 during manufacture of the lamp and during luminous operation of the lamp may be used as such a getter. Since the getter is, furthermore, easily influenced by the temperature, both a getter which functions at a high temperature and a getter which functions at a low temperature are preferably used.

In concave space 10, an inert gas, such as xenon or the like, for example, encapsulated at a pressure of 19 atmospheres is provided. The short arc lamp according to the invention is operated, for example, with 20 volts and 300 watts.

In a lamp with the above described arrangement, during luminous operation of the lamp, a line from a power source is connected to band 21 and front side 41 of conductive ring 4. The current supplied from band 21 flows into base plate 2 and anode 6, then flows, via the arc gap, to the cathode 7, conductive part 5 and conductive ring 4. Furthermore, current can be allowed to flow from conductive band 12 which is connected to the external peripheral surface of conductive ring 4 via the cooling rib.

Next, the provision of the short arc lamp according to the invention with a cooling rib and the installation thereof in a light source device will be described.

Figure 3A:
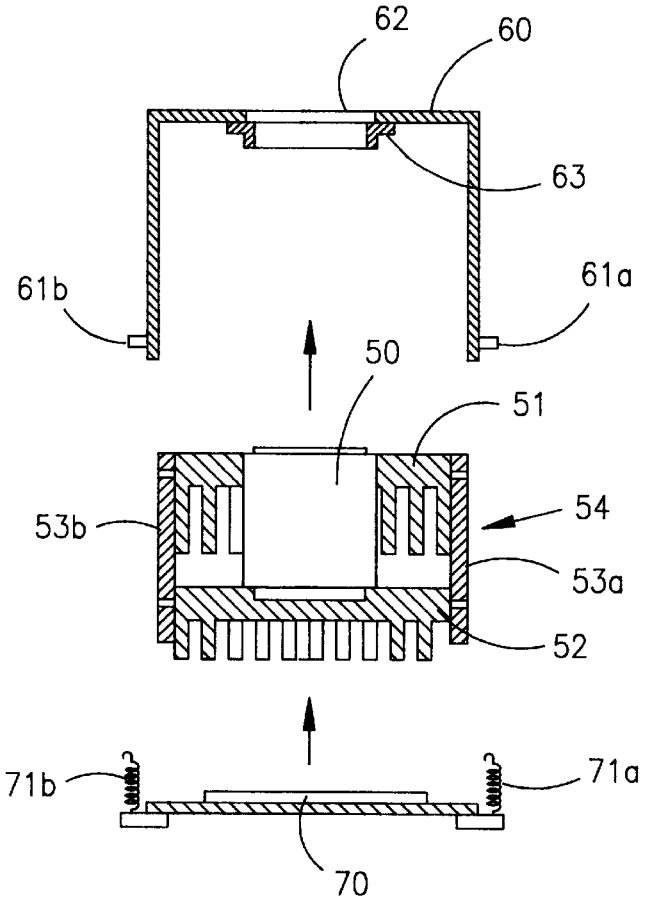
FIGS. 3A–3B are each a schematic cross section of a light source device in which the short arc lamp according to the invention is installed, in exploded and assembled views, respectively.

In FIG. 3A, cathode side cooling rib 51 is installed in the vicinity of the conductive band 12 of lamp 50 and an anode side cooling rib 52 is installed in the vicinity of the metal band 21. The two cooling ribs are installed in side plates 53*a* and 53*b* and together form lamp unit 54. Lamp unit 54 is plugged into a housing 60 to which bottom plate 70 is connected. This connection between housing 60 and bottom plate 70 is effected by hook devices 61*a* and 61*b* on housing 60 being engaged by hook-shaped ends of spring devices 71*a* and 71*b* which are located on bottom plate 70. A light source device which is installed in this way extends in a vertical direction, as shown, and has a cylindrical shape. The entire lamp can be cooled by supplying cooling air.

Figure 3B:
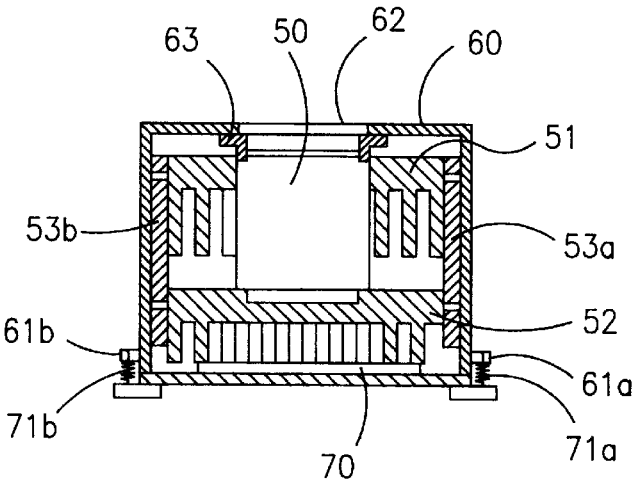

The part of housing 60 opposite the transparent part of lamp 50 is provided with light exit opening 62. Furthermore, in the vicinity of light exit opening 62, a conductive device 63 is provided which is pressed by means of spring device 71 against the conductive ring 14 of lamp 50 (FIG. 3B). Therefore, electricity can flow reliably into the lamp by an electrical connection of the line from the power source to conducting device 63.

Furthermore, as described above, by the measure by which a gap is formed in lamp 50 between conductive ring 4 and frame part 31, a reliable attachment in conductive device 63 is obtained using these steps.

On the other hand, bottom plate 70 is likewise a metallic part which is pressed by means of spring device 71 against anode-side cooling rib 52. Therefore, by laying an electrical line on bottom plate 70, an electrical path can be safely established. In a light source device of this type, housing 60 is made, for example, of an electrically insulating plastic and the cooling rib is formed, for example, of aluminum. Furthermore, the conductive device 63 is made, for example, of phosphor bronze.

Moreover, an electrically insulating material can be placed between the cathode side cooling rib 51 and the conductive band 12. In this way, current flow on the cathode side into cooling rib 51 is prevented and a connection via conductive device 63 is accomplished.

In this way, as shown in FIG. 3B, an arrangement can be obtained in which the ribs are parallelly oriented, and thus, a smaller overall lamp unit is obtained.

For an electrically insulating material of this, "Denka heat radiation plate BFG-20" produced by Denkikagakukogyo can be used. The reason for this is that no discharge occurs between the cooling ribs.

Furthermore, by adjusting the direction of the cooling rib, as is shown in the drawing, the efficiency of cooling with respect to the lamp can be increased even more.

It is to be understood that although a preferred embodiment of the invention has been described, various other embodiments and variations may occur to those skilled in the art. Any such other embodiments and variations which fall within the scope and spirit of the present invention are intended to be covered by the following claims.

We claim:

1. A short arc lamp comprising a lamp body in which a concave space is defined by a curved reflection surface and in a rear part of which a through opening is formed which leads to said concave space, a base plate located on a rear part of the lamp body which is opposite a front opening of the lamp body, said base plate being connected to the lamp body, a transparent part located extending across said front opening of the lamp body and connected to the lamp body by a frame part hermetically enclosing the concave space, and a pair of electrodes located in said concave space at a distance from each other forming an arc gap at a focal point of the reflection surface, said electrodes including an anode held on the base plate and a cathode held by means of an electrically conductive part which extends from the lamp body;

wherein a circular thermally conductive ring provided with a roughly square cross section is connected to the lamp body in proximity to the frame part; wherein at least a front side of the circular thermally conductive ring is exposed to an ambient environment; and wherein a stress-relieving gap is formed between the frame part and the circular thermally conductive ring, axially inwardly of the front side of the circular thermally conductive ring, and wherein said stress-relieving gap opens outwardly to the ambient environment.

2. The short arc lamp according to claim 1, wherein the frame part and the circular conductive ring are interconnected in a rear part thereof.

3. The short arc lamp according to claim 1, wherein the stress-relieving gap between the frame part and the circular thermally conductive ring is conically shaped.

4. The short arc lamp according to claim 3, wherein the frame part extends forwardly beyond the circular thermally conductive ring in a direction of light emission; and wherein a step-like projection is formed on an outer surface of the circular thermally conductive ring and on a side of the frame part which extends beyond the thermally conductive ring.

5. The short arc lamp according to claim 2, wherein the frame part extends forwardly beyond the circular thermally conductive ring in a direction of light emission; and wherein a step-like projection is formed on an outer surface of the circular thermally conductive ring and on a side of the frame part which extends beyond the thermally conductive ring.

6. The short arc lamp according to claim 1, wherein the frame part extends forwardly beyond the circular thermally conductive ring in a direction of light emission; and wherein a step-like projection is formed on an outer surface of the circular thermally conductive ring and on a side of the frame part which extends beyond the thermally conductive ring.

7. The short arc lamp according to claim 1, wherein a thermally conductive device is provided which is pressed against the front side of the circular thermally conductive ring.

8. The short arc lamp according to claim 7, wherein the thermally conductive device is attached to a lamp housing and has a transparent window aligned with the transparent part located in the front opening of said lamp body.

* * * * *